US006213203B1

(12) United States Patent
Edwards et al.

(10) Patent No.: US 6,213,203 B1
(45) Date of Patent: Apr. 10, 2001

(54) LOCK MECHANISM FOR USE WITH A DOWNHOLE DEVICE

(75) Inventors: A. Glen Edwards, Hockley; Klaus B. Huber, Sugarland, both of TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/221,667

(22) Filed: Dec. 23, 1998

Related U.S. Application Data

(62) Division of application No. 08/752,810, filed on Nov. 20, 1996, now Pat. No. 5,887,654.

(51) Int. Cl.[7] ..... E21B 23/00
(52) U.S. Cl. ..... 166/55.1; 175/4.54; 175/4.56
(58) Field of Search ..... 175/4.54, 4.55, 175/4.56; 166/55.1

(56) References Cited

U.S. PATENT DOCUMENTS

| | | | | |
|---|---|---|---|---|
| 3,398,803 | | 8/1968 | Leutwyler et al. | 175/4.52 |
| 3,612,189 | | 10/1971 | Brooks et al. | 175/4.54 |
| 3,648,785 | | 3/1972 | Walker | 175/4.54 |
| 3,717,095 | | 2/1973 | Vann . | |
| 4,403,659 | * | 9/1983 | Upchurch | 166/374 |
| 4,496,010 | | 1/1985 | Chapman, III | 175/4.55 |
| 4,541,486 | | 9/1985 | Wetzel et al. | 166/297 |
| 4,606,409 | | 8/1986 | Peterson et al. | 166/297 |
| 4,612,992 | | 9/1986 | Vann et al. | 166/297 |
| 4,616,718 | | 10/1986 | Gambertoglio | 166/297 |
| 4,619,333 | | 10/1986 | George | 175/4.52 |
| 4,629,001 | | 12/1986 | Miller et al. | 166/297 |
| 4,650,001 | * | 3/1987 | Ringgenberg | 166/373 |
| 4,678,044 | | 7/1987 | George et al. | 175/4.52 |
| 4,736,798 | * | 4/1988 | Zunkel | 166/321 |
| 4,817,718 | | 4/1989 | Nelson et al. | 166/297 |
| 4,880,056 | | 11/1989 | Nelson et al. | 166/51 |
| 4,969,525 | | 11/1990 | George et al. | 166/297 |
| 5,029,642 | * | 7/1991 | Crawford | 166/72 |

(List continued on next page.)

FOREIGN PATENT DOCUMENTS

| | | |
|---|---|---|
| 0 180 520 A2 | 5/1986 | (EP) . |
| 0319321 A1 | 6/1989 | (EP) . |
| 0585142 A2 | 3/1994 | (EP) . |
| 0647766 A2 | 4/1995 | (EP) . |
| WO 93/20330 A1 | 10/1993 | (WO) . |
| WO 94/21882 | 9/1994 | (WO) . |

OTHER PUBLICATIONS

Bussear, "Remote actuation system speeds deepwater well completion", *Oil & Gas Journal* 94:56–59 (1996).

*Primary Examiner*—Hoang Dang
(74) *Attorney, Agent, or Firm*—Trop, Pruner & Hu P.C.

(57) ABSTRACT

A downhole device and method for performing a function in a well. The device has a series of dedicated hydro-mechanical locks that prevent occurrence of an associated function. The hydro-mechanical locks are capable of being released directly by a respective elevated hydraulic activating pressure condition, and are constructed and arranged for sequential operation, such that a successive lock in the series cannot be released until after the hydraulic pressure condition required to release the preceding lock in the series has occurred. In a preferred embodiment, an actuator sequentially releases each lock in a series of locks, subsequently moving an operator to perform a function. A preferred implementation employs a series of resilient rings movable, sequentially, from a locking to an unlocking position, and a common actuator that effects these movements. Multiple devices of this construction are advantageously arranged in a string of tools to perform functions in any preprogrammed order by pre-selecting the number of locks in each device. Methods of performing sequences of downhole well functions are also disclosed.

32 Claims, 7 Drawing Sheets

U.S. PATENT DOCUMENTS

| | | | |
|---|---|---|---|
| 5,078,210 | 1/1992 | George | 166/55 |
| 5,103,912 | 4/1992 | Flint | 166/297 |
| 5,115,865 | 5/1992 | Carisella et al. | 166/297 |
| 5,161,616 | 11/1992 | Colla | 166/297 |
| 5,165,489 | 11/1992 | Langston | 175/4.54 |
| 5,277,262 | 1/1994 | Huber et al. | 175/454 |
| 5,287,924 | 2/1994 | Burleson et al. | 166/297 |
| 5,318,130 | 6/1994 | Manke | 166/373 |
| 5,355,957 | 10/1994 | Burleson et al. | 166/297 |
| 5,447,202 | 9/1995 | Littleford | 166/381 |
| 5,505,261 | 4/1996 | Huber et al. | 166/297 |
| 5,598,894 | 2/1997 | Burleson et al. | 175/4.52 |

* cited by examiner

LOCK MECHANISM FOR USE WITH A DOWNHOLE DEVICE

This is a divisional of commonly assigned U.S. patent application Ser. No. 08/752,810, entitled "DEVICE AND METHOD FOR PERFORMING DOWNHOLE FUNCTIONS," filed Nov. 20, 1996, now U.S. Pat. No. 5,887,654.

BACKGROUND OF THE INVENTION

This invention relates generally to the field of performing downhole functions in a well, and is particularly applicable to downhole well completion tools.

In completing a product recovery well, such as in the oil and gas industry, several downhole tasks or functions must generally be performed with tools lowered through the well pipe or casing. These tools may include, depending on the required tasks to be performed, perforating guns that ballistically produce holes in the well pipe wall to enable access to a target formation, bridge plug tools that install sealing plugs at a desired depth within the pipe, packer-setting tools that create a temporary seal about the tool and valves that are opened or closed.

Sometimes these tools are electrically operated and are lowered on a wireline, configured as a string of tools. Alternatively, the tools are tubing-conveyed, e.g. lowered into the well bore on the end of multiple joints of tubing or a long metal tube or pipe from a coil, and activated by pressurizing the interior of the tubing. Sometimes the tools are lowered on cables and activated by pressurizing the interior of the well pipe or casing. Other systems have also been employed.

SUMMARY OF THE INVENTION

In one aspect of the invention, a downhole device for performing a function in a well has a series of dedicated hydro-mechanical locks that prevent occurrence of the function until desired. The hydro-mechanical locks are each capable of being released directly by a respective elevated hydraulic activating pressure condition and are constructed and arranged for sequential operation such that a lock in the series cannot be released until after the hydraulic pressure conditions required to release any preceding locks in the series have occurred.

In one embodiment, the device is in the form of a self-contained downhole device for controlling the occurrence of the function. In this embodiment, the device includes a downhole housing and a port in the housing in hydraulic communication with a remote hydraulic pressure source via the well by pressure-transmitting structure such as casing or tubing in the well.

In some embodiments, the series of hydro-mechanical locks comprises a set of one or more displaceable elements associated with a common hydraulic actuator, the actuator constructed and arranged to displace the elements sequentially. In some cases the actuator is responsive to an increase in hydraulic pressure to advance to engage an element and to a subsequent decrease in hydraulic pressure to move the element from a locking to an unlocking position.

Some preferred embodiments contain one or more of the following features: the actuator has a piston; the actuator is biased to a first position by a spring, the activating pressure condition moving the actuator to a second, activated position; the elements each comprises a ring, which in some embodiments is resiliently radially compressed, in a locking, unreleased condition, within a first bore of a lock housing; the actuator has a ring gripper for moving the ring; the lock housing has a second, larger bore into which the ring is movable to an unlocking, released position; the ring has an engageable cam surface; the gripper has a finger with a cam surface for engaging the cam surface of the ring, and in some instances a lift formation for lifting any previously released rings to enable the disengagement of an engaged ring from the cam surface of the gripper.

In some embodiments of the invention, the spring comprises a compressible fluid which is compressed in a first chamber by said actuator. In a particularly useful arrangement, the device also has an orifice for restricting a flow of the compressible fluid from the first chamber to a second chamber, enabling the respective activating pressure condition to cause the actuator to compress the fluid in the first chamber. In some instances the device has a third chamber and a floating piston disposed between the second and third chambers, the floating piston containing a one-way check valve constructed to enable flow from the second chamber to the third chamber. In this arrangement the construction of the floating piston advantageously enables oil within the first and second chambers to expand at higher temperatures.

In another embodiment, the series of hydro-mechanical locks comprises one or more valves, each valve arranged to be openable to a released condition in response to an activating hydraulic pressure condition. In a current arrangement, each of the valves has an inlet to receive activating pressure, and an outlet blocked from the inlet until after a respective activating pressure condition has occurred. In some arrangements, the outlet of the valve is hydraulically connected to an inlet of a pressure-activated tool.

In a particularly useful configuration, the valve is constructed to delay opening for a predetermined amount of time after the occurrence of a respective activating pressure condition. This delay time enables the inlet pressure condition to the valve to be reduced before the valve opens. In this manner, the opening of an upper valve in a series of valves does not immediately open a lower valve, enabling a series of such valves to be independently, sequentially opened by a sequence of activating pressure conditions.

Some configurations may have one or more of the following features: the valve has a piston that forces a fluid through an orifice to expose a port to open the valve; and the delay time between the occurrence of the respective activating pressure condition and the opening of the valve is determined at least in part by the size of the orifice.

In another aspect of the invention, a string of tools for performing downhole functions in a well includes a number of functional sections arranged in a physical order within the string along a string axis. At least one of the sections has a downhole device with a series of dedicated hydro-mechanical locks that prevent occurrence of an associated function. The hydro-mechanical locks are each capable of being released directly by a respective elevated hydraulic activating pressure condition, and are constructed and arranged for sequential operation such that a lock in the series cannot be released until after the hydraulic pressure condition required to release any preceding lock in the series has occurred.

In a particularly advantageous configuration, at least three of the sections each have such a device, the string being arranged and configured to perform the functions in an order other than the physical order of the sections along the axis.

In a preferred embodiment, the sections are constructed to enable activating pressure conditions to be applied simultaneously to all of the functional sections having the devices.

In some useful configurations, a first device in the string has at least one fewer dedicated hydro-mechanical locks than a second device in the string, the actuating pressure conditions for releasing the locks of the first and second devices being correlated such that pairs of locks of the first and the second devices are simultaneously released, resulting in all locks being released in the first device while a lock remains unreleased in the second device.

In another aspect of the invention, a downhole device for performing a function in a well has an actuator arranged to move along an axis in response to an activating pressure condition, an operator engageable by the actuator and arranged to cause the function to be performed when moved, and at least one lock element engageable by the actuator and disposed axially, in a locking position, between the actuator and the operator. The actuator is constructed and arranged to, in response to a first activating pressure condition, engage and move the lock element to a non-locking position, and subsequently, in response to a second activating pressure condition, to engage and move the operator to cause the function to be performed.

In a preferred embodiment, there are more than one lock element arranged in series between the actuator and the operator. In a preferred configuration, the axial motion of the actuator is limited by the lock element.

In another aspect of the invention, a method of performing a sequence of downhole functions in a well comprises lowering a string of tools, the string having a functional section associated with each function. At least two of the sections each has a device with a series of dedicated hydro-mechanical locks that prevent occurrence of the function associated with the section. The hydro-mechanical locks are capable of being released directly by a respective elevated hydraulic activating pressure condition, and are constructed and arranged for sequential operation, such that a lock in the series cannot be released until after the hydraulic pressure conditions required to release any preceding locks in the series have occurred.

The method also comprises applying a sequence of activating hydraulic pressure conditions to the string, a given activating pressure condition releasing an associated lock in predetermined functional sections having unreleased locks. The functional sections having the devices each perform their associated functions in response to an activating pressure condition occurring after all locks of the section have been released.

In some embodiments, at least one of the functional sections perforates the well in response to an activating pressure condition occurring after all locks within the section have been released.

In a particularly useful embodiment, the method includes maintaining the axial position of the string within the well while applying the sequence of activating pressure conditions to set a bridge plug at a first axial well position, set a packer at a second axial well position, and subsequently perforate the well between the first and second axial well positions.

In another embodiment, the method of the invention further includes maintaining the axial position of the string within the well while sequentially performing functions associated with at least three sections of the string. The sections include an upper section, a lower section, and at least one middle section, according to positions along an axis of the string. The method further includes performing the associated functions in an order starting with the function associated with a middle section.

In another embodiment, at least three of the sections are operated by the sequence of activating hydraulic pressure conditions to perforate upper, lower and middle well zones, the middle zone being perforated first.

In yet another useful embodiment, the method further comprises applying an elevated downhole test pressure. The test pressure releases an associated lock in each functional section having unreleased locks without causing any functional section to perform its associated function.

The invention advantageously enables functional tools to be arranged in a single downhole string in any desired physical order, and activated in any preselected sequence. This flexibility can be very useful, e.g. for perforating multiple zones in a well starting with a middle zone, or for perforating between a preset bridge plug and preset packer.

The invention also enables various arrangements of downhole tasks to be performed with a single string of tools, requiring only one trip down the well, thereby saving substantial rig time. Used in a triggering mechanism to trigger a detonation to activate a tool, the invention also advantageously avoids potential failure modes of electrically-activated downhole equipment and associated safety risks, by employing only hydro-mechanical downhole equipment for triggering detonations.

In embodiments in which the device according to the invention is employed to activate a tool, the activation of any of the tools in the string advantageously does not depend upon the previous activation of any other tools in the string, such that the failure of one tool to properly perform does not inhibit the operation of the other tools in the string.

These and other advantageous features are realized in equipment that is simple, reliable and relatively inexpensive.

DESCRIPTION OF THE PREFERRED EMBODIMENTS

Figure 1:
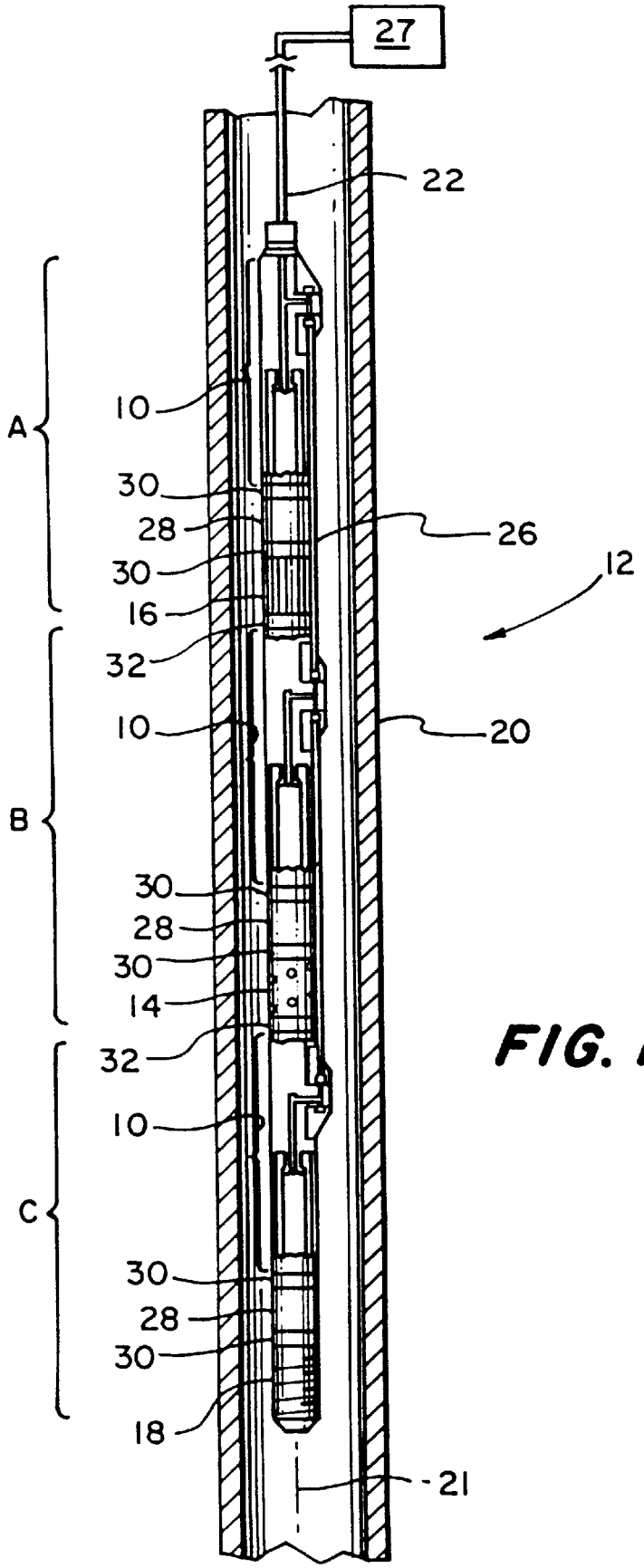
FIG. 1 is a diagrammatic illustration of a tool string in a well, according to the invention.

Referring to FIG. 1, a hydraulic programmable firing head 10 according to the invention is part of a string 12 of tools that can be arranged in various ways to selectively enable multiple operations to be performed in a well 20, such as setting a bridge plug or packer, pressure testing the plug or packer, and perforating one or more zones, all in one trip in the well. The hydraulic programmable firing head 10 is adapted to initiate a downhole event when a preprogrammed number of activating pressure cycles have been received. As shown in FIG. 1, firing head 10 is capable of triggering a perforating gun 14, a packer-setting tool 16, a bridge plug tool 18, or any other downhole tool configured to perform a task. Multiple hydraulically programmable firing heads 10 can be used in a string 12 of tools, as shown, to trigger any desired arrangement of tools along the axis 21 of the string in any preprogrammed order.

String 12 is lowered into well 20 on the end of tubing 22, which is filled with hydraulic fluid. Hydraulic communication lines 26, also filled with fluid, hydraulically connect each firing head 10 in parallel communication with a remote source 27 via tubing 22, such that pressure applied at the top end of tubing 22 will be applied simultaneously to all firing heads 10 in the string. By provision of a suitably selected number of dedicated hydro-mechanical locks in the respective firing heads 10, the firing heads are each capable of being mechanically configured to trigger an associated tool or event upon receipt of a preselected number of actuation cycles. The firing heads can be set up such that a series of pressure cycles received by string 12 through tubing 22 sequentially triggers each tool or event in a predetermined order, without dependence on the arrangement of tools along the string, as described below.

As indicated in FIG. 1, string 12 comprises a series of self-contained functional sections A, B and C, with each section comprising a firing head 10 and an associated tool, e.g. a perforating gun 14, a packer-setting tool 16, a bridge plug tool 18, or other tool. The firing heads 10 are each connected to their associated tools with safety spacers 28 and sealed ballistic transfers 30. Sections A, B and C are separated from each other by blank subs 32. Each firing head 10 triggers its associated tool ballistically by initiating a detonation which is transferred to the associated tool through the sealed ballistic transfers 30 and safety spacer 28. Ballistic transfers 30 and blank subs 32 are internally sealed to prevent fluid from flowing between firing heads 10, safety spacers 16 and tools. FIG. 1 illustrates the relative placement of each component in string 12, and does not represent their proportionate dimensions. String 12 may consist of any number of functional sections A, B, C, and so forth, each comprising a firing head and an associated tool as described above, each in parallel hydraulic communication with tubing 22. Each associated tool may be configured to perform a downhole task, such as perforating the well, setting a packer or bridge plug, operating a valve, moving a sleeve, or otherwise causing a desired event to occur within the well.

Figure 2:
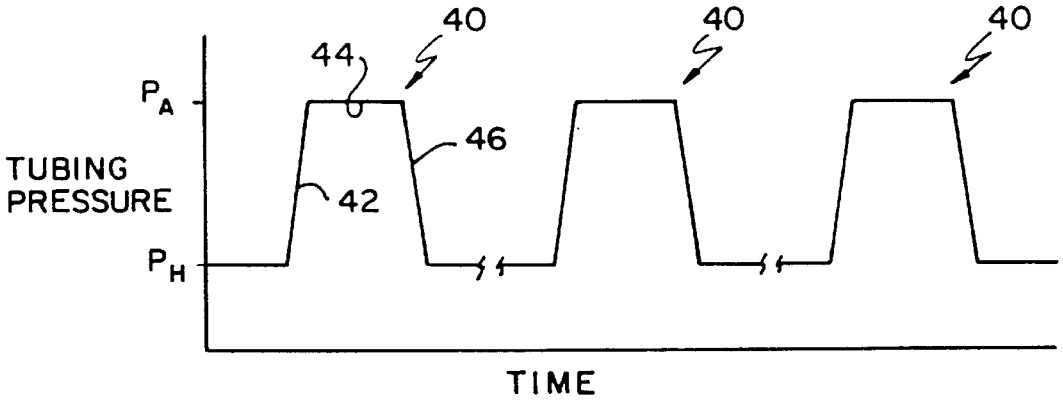
FIG. 2 illustrates a series of activating pressure cycles applied to a tool string.

Referring to FIG. 2, string 12 of FIG. 1 is activated from the surface of the well by a series of activating pressure cycles 40 applied to the fluid within tubing 22. Each pressure cycle spans at least 3 or 4 minutes in the current configuration, and consists of a pressure increase 42 from hydrostatic pressure $P_H$ to activation pressure ($P_A$ which is sufficiently above the pressure required to activate each firing head 10), a pressure dwell period 44 at activation pressure $P_A$, and a pressure decrease 46. In the current configuration, as described below, pressure cycles 40 are separated by a length of time sufficient to return internal chamber pressures to hydrostatic pressure $P_H$.

Figures 3A, 3B, 3C, 3D:
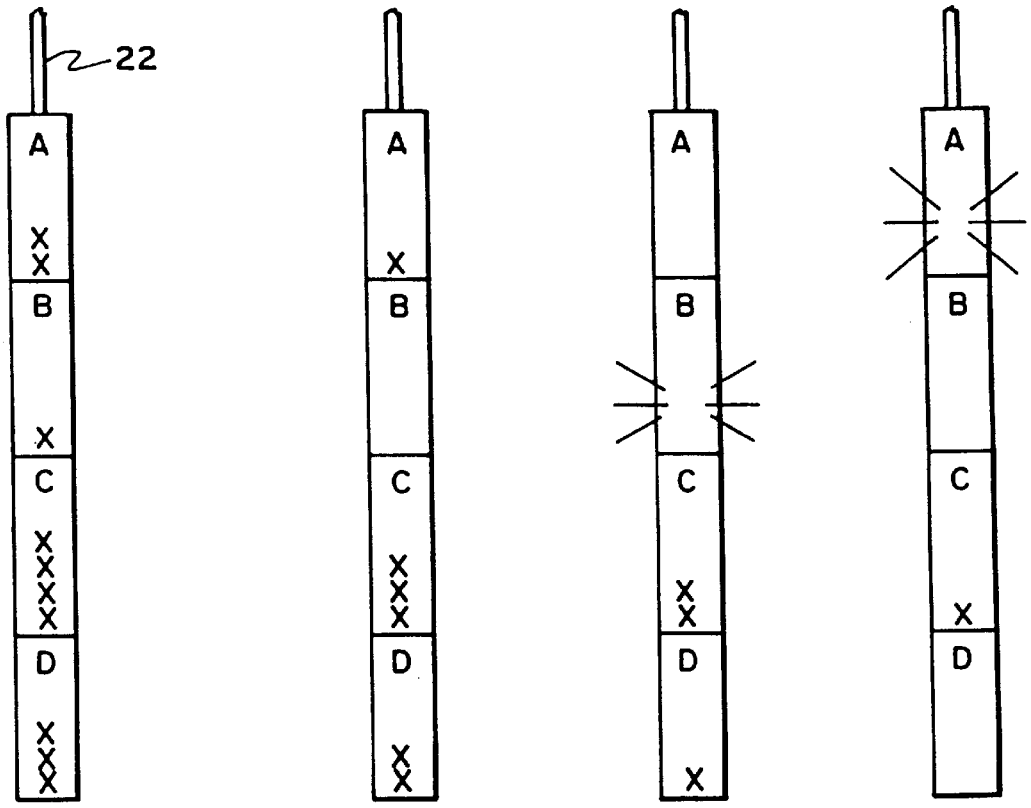
FIGS. 3A through 3D schematically illustrate the sequential operation of four tools in a string, according to the invention.

Referring also to FIGS. 3A through 3D, string 12 is diagrammatically illustrated as a series of four functional sections A, B, C and D, although it should be understood that the string may consist of more or fewer self-contained sections. The firing head in each section contains a series of dedicated, hydraulically-releasable hydro-mechanical locks, each unreleased lock illustrated as an X in the figures. As initially placed in the well (FIG. 3A), the firing head of section A contains two such locks; section B, one lock; section C, four locks; and section D, three locks. Each pressure cycle 40 within tubing 22 releases one lock X from the firing head of each section. If a given section has no unreleased locks X, a next pressure cycle 40 causes the firing head in the given section to trigger its associated event or tool. After a first pressure cycle 40 (FIG. 3B), section A contains only one unreleased lock X, section B has no more unreleased locks, and sections C and D have three and two unreleased locks X, respectively. After a second pressure cycle 40, one additional lock X in each of sections A, C and D has been released, such that section A has no more unreleased locks and sections C and D have two and one, respectively (FIG. 3C). Because section B had no unreleased locks upon receipt of the second pressure cycle, the firing head in section B triggers its associated tool or event due to the second pressure cycle 40. A third pressure cycle 40 causes the firing head in section A to trigger and leaves only one unreleased lock X in section C, none in D (FIG. 3D). Not shown, a fourth pressure cycle causes the firing head in section D to trigger, and a fifth pressure cycle causes the firing head in section C to trigger.

Figure 3E:
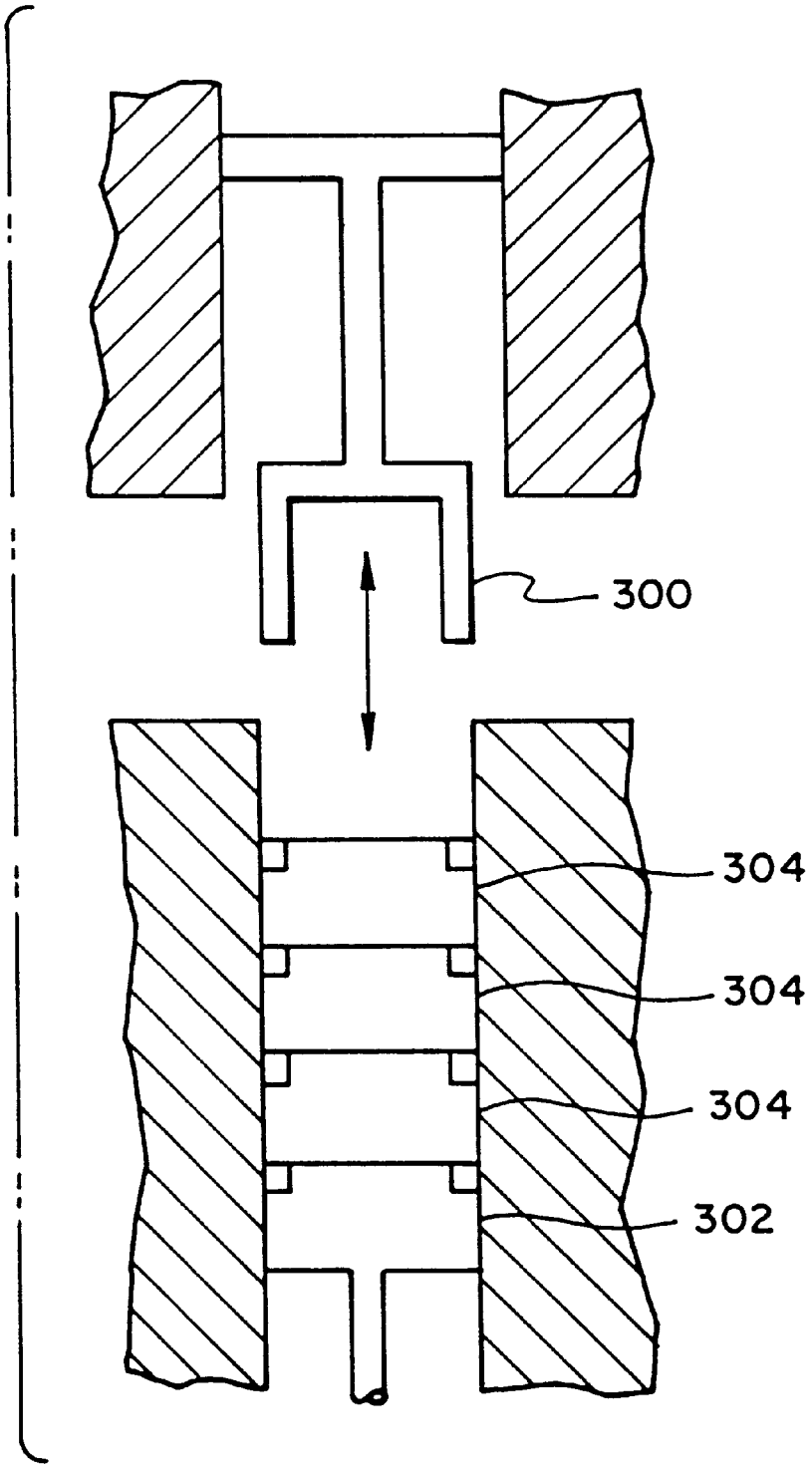
FIG. 3E schematically illustrates a lock-releasing actuator, according to the invention.

In certain preferred embodiments the hydro-mechanical locks are of the form of displaceable elements, and a common actuator is employed. Referring for example to FIG. 3E, a firing head or other downhole device includes a hydraulically actuated gripper 300 that is moved axially to engage an operator 302 by the application of an activating pressure. At least one lock element 304 is positioned between gripper 300 and operator 302, such that cycles of application and release of activating pressure sequentially move lock elements 304 to a released position, exposing operator 302 for engagement upon the next application of activating pressure. As shown, a selected number of lock elements 304 are placed in series, such that successive pressure cycles release respective lock elements until the release of the last unreleased lock element in the series exposes operator 302 for engagement. Once engaged, operator 302 is subsequently moved by a reduction in pressure, causing an associated downhole function to be performed.

In particularly preferred embodiments, the displaceable lock elements are c-rings that are sequentially moved by a common downhole actuator in the form of a hydraulic piston and a device for engaging the rings, referred to herein as a ratchet grip. The details of this implementation will now be described.

Figure 4:
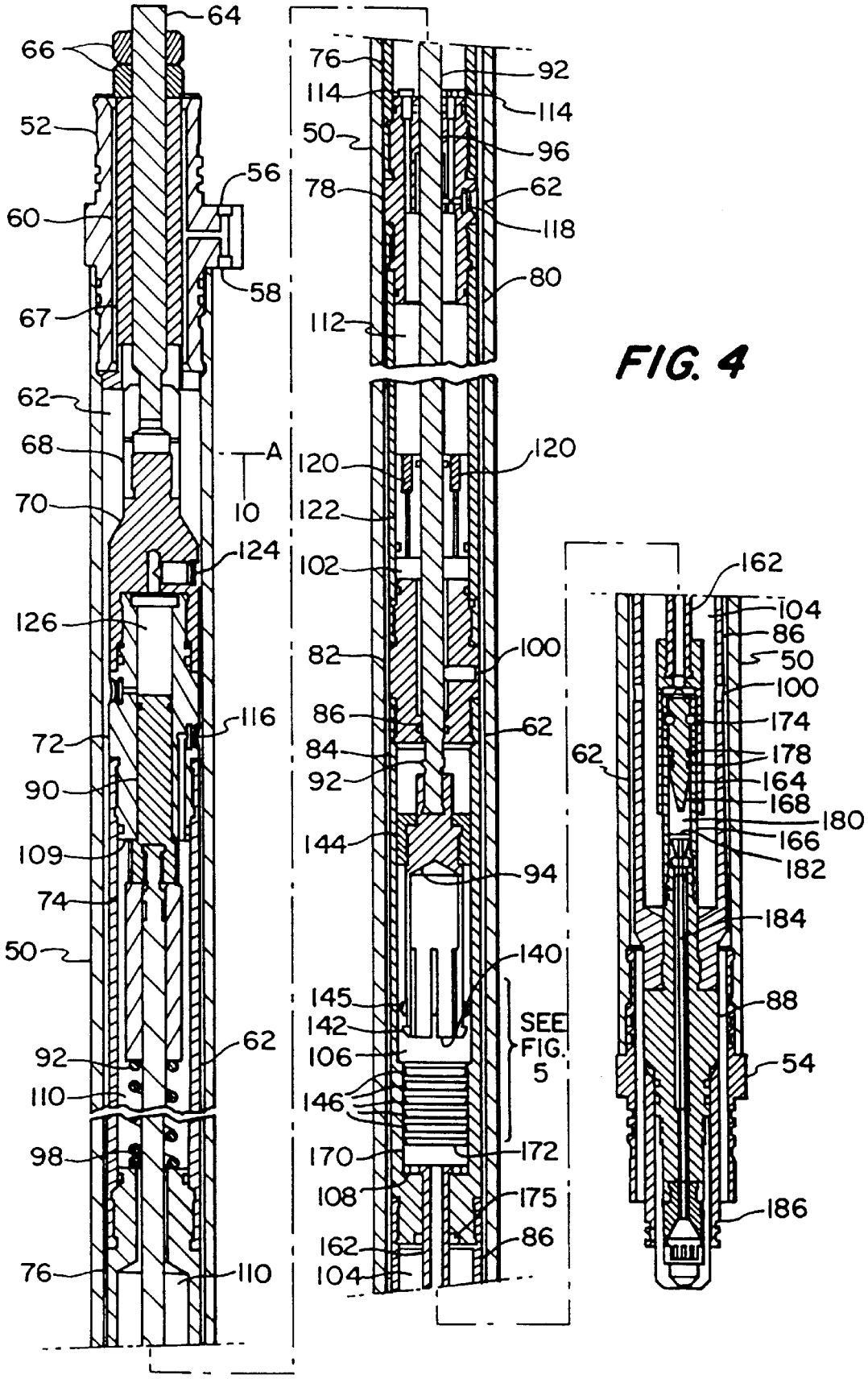
FIG. 4 is a cross-sectional view of a hydraulically programmable firing head in a fill sub, according to a first embodiment.

Referring to FIG. 4, the hydraulic programmable firing head 10 is located within a fill sub 50, which is attached to the rest of the string of downhole equipment by a fill sub connector 52 at the top end of the fill sub, and a lower adaptor 54 at the bottom end of the fill sub. Firing head 10 comprises the internal components housed within fill sub 50 and lower adaptor 54 below level A in the figure. Fill sub connector 52 has upper and lower threaded ports, 56 and 58, respectively, for attaching hydraulic communication lines 26 (FIG. 1). To configure firing head 10 to be the upper firing head in the string, upper threaded port 56 is typically plugged and an upper tubing connector (not shown) provides a hydraulic connection, internal to the string, between annulus 60 within fill sub connector 52 and tubing 22, while lower threaded port 58 provides a hydraulic connection, through an external communication line 26 (FIG. 1), to the upper threaded port 56 of a lower firing head fill sub connector 52. To configure the firing head to be the lowest in the string of multiple firing heads, lower threaded port 58 is plugged, and upper threaded port 56 provides a hydraulic link to the upper firing heads and tubing 22. In middle firing heads, both the upper and lower ports 56 and 58 are employed for communication (FIG. 1).

Annulus 62 within fill sub 50 is open to annulus 60 within fill sub connector 52, and runs the length of the firing head, which is axially retained in the fill sub with threaded rod 64, jam nut 66, sleeve 67 and threaded collar 68. Upper head 70, piston guide 72, oil chamber housing 74, oil chamber extension 76, stem guide 78, piston housing 80, housings connector 82, ratchet housing 84, release sleeve housing 86 and detonator adaptor 88 are stationary components of firing head 10, all connected in succession by threaded joints. Within piston guide 72 is a movable piston 90 connected to the upper end of a long operating stem 92 that runs through the center of the firing head, the lower end of the operating stem being connected to a movable, ring-grasping ratchet grip 94. Operating stem 92 is supported along its length by guide bearing surfaces 96 in oil chamber extension 76, stem guide 78 and housings connector 82, such that it is free to move axially with movable piston 90. A compression spring 98 around stem 92 within oil chamber housing 74 biases piston 90 and ratchet grip 94 in an upward direction. Side ports 100 in housings connector 82 and release sleeve housing 86 permit hydraulic flow between fill sub annulus 62 and oil chambers 102 and 104, respectively. Fluid can also flow from chamber 104 in release sleeve housing 86 to chamber 106 in ratchet housing 84, through an open inner bore of release sleeve operator 108, such that activation pressure is always applied, through fill sub annulus 62, to the lower end of stem 92, and acts, along with compression spring 98, to bias piston 90 in an upward direction to an inactivated position against a stop shoulder 109 of piston guide 72. Compression chamber 110, which extends through oil chamber housing 74 and oil chamber extension 76, is pre-filled, through a subsequently plugged side port 116 in piston guide 72, with a highly compressible silicon oil, typically compressible to about 10% by volume. Middle chamber 112 is also pre-filled with compressible silicon oil through a subsequently plugged side port 118 in stem guide 78, and is hydraulically connected to compression chamber 110 through flow-restricting orifices 114 in stem guide 78. Two jets, i.e. Lee Visco brand jets with an effective flow resistance of 243,000 lohms, are employed as orifices 114. One-way ball check valves 120 in a floating piston 122, located in piston housing 80, allow the silicon oil in chambers 110 and 112 to expand at higher well temperatures, without allowing upward flow from chamber 102 to chamber 112. Because floating piston 122 is free to move axially within piston housing 80, the pressure in chamber 112 is always substantially equal to the pressure in chamber 102, which is the same as annulus 62 pressure, e.g. tubing pressure. Flow-restricting orifices 114 slowly allow the pressure in compression chamber 110 to equalize to tubing pressure, such that by the time the string is in place at the bottom of a well, chambers 104, 106, 102, 112 and 110 are all substantially at hydrostatic tubing pressure.

A rupture disk 124 in upper head 70 prevents the pressurization of upper piston chamber 126 until the pressure in annulus 62 exceeds a level required to rupture disk 124, ideally higher than the maximum expected hydrostatic pressure ($P_H$ in FIG. 2), and lower than activation pressure $P_A$. Upon the application of a first activation pressure cycle 40 (FIG. 2), rupture disk 124 ruptures, and tubing pressure is applied to the top of piston 90, moving piston 90, stem 92 and ratchet grip 94 downward against compression spring 98. Tubing pressure, which is substantially equal to the pressure in chamber 112, must be increased rapidly so that the piston 90 can move downward and compress the silicon oil in compression chamber 110. If the tubing pressure is increased too slowly, flow across orifices 114 will equalize the pressure between chambers 112 and 110, bringing the silicon oil in chamber 110 up to tubing pressure, in which case tubing pressure will be effectively applied to both sides of piston 90, and no activating motion of the piston and ratchet grip 94 will occur. Tubing pressure is typically increased to a level $P_A$ of about 3500 psi above hydrostatic pressure $P_4$ in about 30 seconds, moving piston 90 and ratchet grip 94 downward, and held at that level for a dwell time of two to three minutes before being released. When the tubing pressure is released back to hydrostatic level $P_H$, piston 90 and ratchet grip 94 are returned to their initial dispositions by the pressure of the compressed silicon oil in compression chamber 110 and compressed spring 98. Between successive pressure cycles, chambers 104, 106, 102, 112 and 110 all return substantially to hydrostatic pressure.

Figure 5:
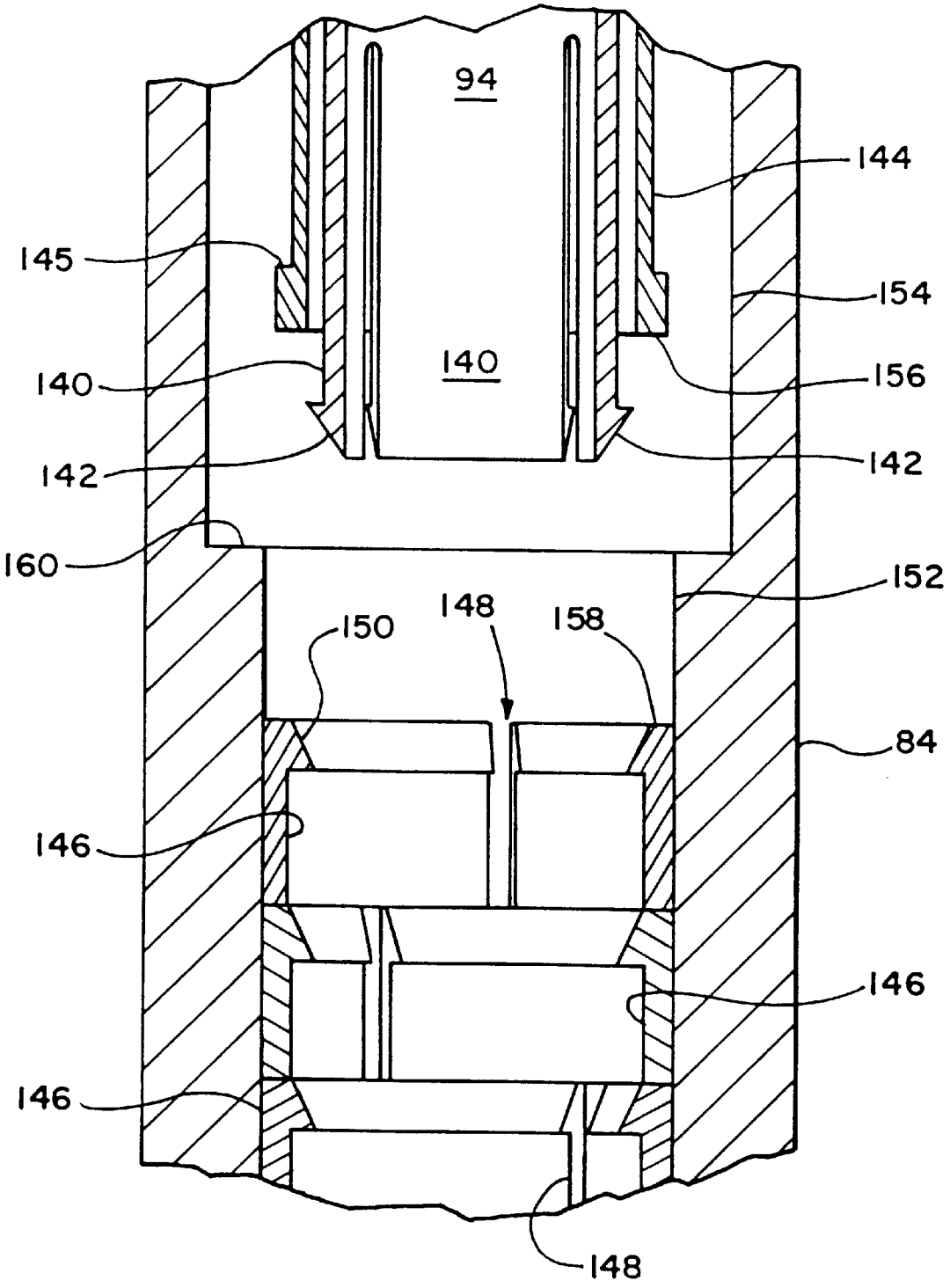
FIG. 5 is an enlarged view of area 5 in FIG. 4.

Referring to FIG. 5, ratchet grip 94 has resilient fingers 140 with outwardly facing cam surfaces 142 at their distal ends. Attached to and moving with ratchet grip 94 is a ratchet grip guide 144 with an outwardly-facing lip about its lower end with an upper surface 145. C-ring locks 146, preferably made of spring metal, such as beryllium copper, each has a vertical slit 148 and an inwardly-facing engageable cam surface 150. The C-rings are disposed, in a locked position, in a small bore 152 of ratchet housing 84, the small bore having a smaller diameter than the free outer diameter of the c-ring so that the c-rings are in a radially compressed state. Friction between the facing surfaces of c-ring 146 and bore 152 retain the c-ring locks in their locked position.

To release the top c-ring lock 146 in a series of locks, the top c-ring lock 146 is moved to a released or unlocked position in a large bore 154 of ratchet housing 84 by an axial motion cycle of ratchet grip 94. In response to the application of an elevated activating pressure condition in a pressure cycle, as described above, ratchet grip 94 and ratchet grip guide 144 are forced downward until a lower surface 156 of ratchet grip guide 144 contacts an upper stop surface 158 of the top c-ring lock 146, and cam surfaces 142 of resiliently bendable fingers 140 snap outwardly underneath cam surface 150 of the upper c-ring in an engaging, ring-grasping motion. When tubing pressure is released and ratchet grip 140 moves upward to its initial position, work is performed as the grasped c-ring 146 is pulled upward, against resistance to its movement, into large bore 154. Once within the large bore, spring force in the compressed c-ring opens the ring to a relatively relaxed state, disengaging c-ring 146 from ratchet grip fingers 140 and releasing the c-ring to be supported by lower bore shoulder 160 of ratchet housing 84.

Figure 6A:
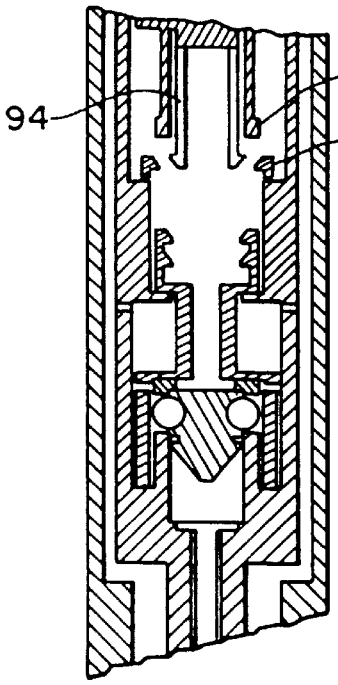
FIGS. 6A through 6E diagrammatically illustrate the operation of part of the lock-releasing mechanism of FIG. 4.
Figure 6B:
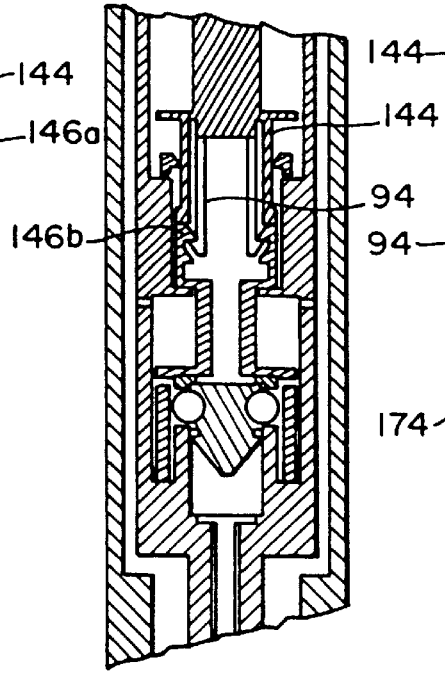
Figure 6C:
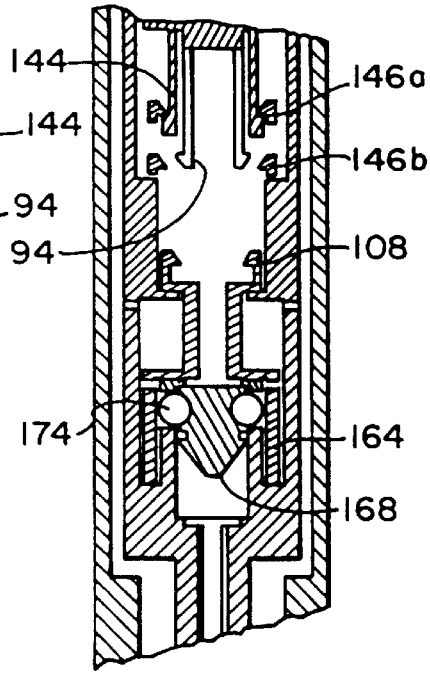

Further lock-releasing actions of this embodiment are illustrated diagrammatically in FIGS. 6A through 6E. In FIG. 6A, the top c-ring lock 146*a* has been released as described above. Upon the application of a second elevated pressure condition, lip surface 145 of ratchet grip guide 144 resiliently expands the released c-ring 146*a* as the ratchet grip guide passes downward into small bore 152 with ratchet grip 94, where lower grip guide surface 156 contacts the upper stop surface 158 of the next unreleased c-ring 146*b*, with cam surfaces 142 of fingers 140 engaging cam surface 150 of ring 146*b* (FIG. 6B). When the activating pressure is reduced a second time, engaged c-ring 146*b* is raised into large bore 154 by ratchet grip 94, and released c-ring 146*a* is raised from shoulder 160 by ratchet grip guide 144, making room for engaged ring 146*b* to be released into large bore 154 (FIG. 6C). This lock-releasing process is continued with further pressure cycles until all c-ring locks 146 are released. In a presently preferred configuration, the actuator and bores are sized in length to receive up to five preset c-rings in small bore 152.

Figure 6D:
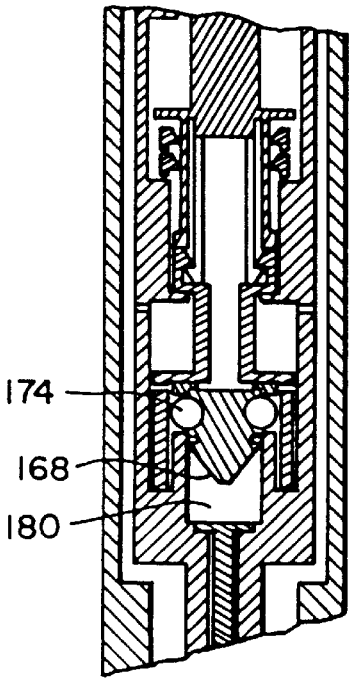
Figure 6E:
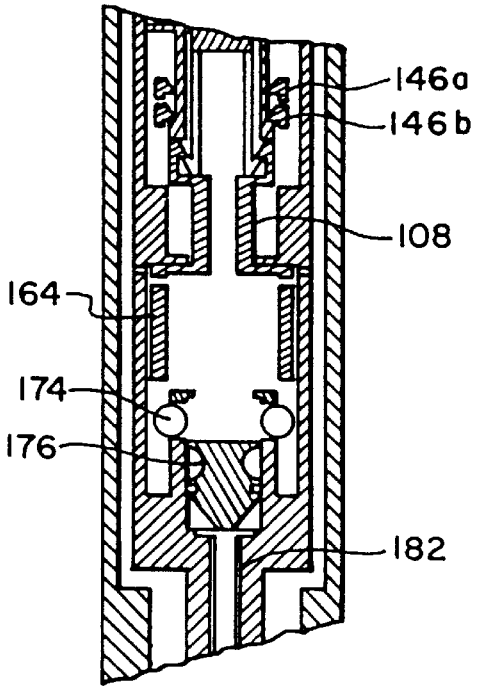

Referring also to FIG. 4, below the lowest c-ring lock 146, e.g. the last in the series, is the release sleeve operator 108 which has a stem section 162 connected to a release sleeve 164 disposed about a firing pin housing 166 enclosing a firing pin 168. Release sleeve operator 108 also has an upper section 170 with an inwardly-facing, engageable cam surface 172, similar to cam surface 150 of split c-rings 146. After all installed c-rings 146 have been released, a next pressure cycle forces ratchet grip 94 downward to engage release sleeve operator 108 (FIG. 6D). Upon a subsequent reduction of tubing pressure, engaged release sleeve operator 108 is pulled upward by ratchet grip 94, thereby raising release sleeve 164 (FIG. 6E). An o-ring 175 within ratchet housing 84 provides some frictional resistance to the motion of release sleeve operator 108.

Until release sleeve 164 is raised from its initial position, firing pin 168 is retained axially by four balls 174 within holes in firing pin housing 166 (FIG. 4), which is connected to detonator adapter 88. The balls extend inwardly into a circumferential groove 176 in the firing pin, retaining the firing pin against axial motion. O-rings 178 around firing pin 168 keep tubing pressure, to which the upper end of the firing pin is subjected, from detonator cavity 180. When the release sleeve is pulled upward, the downward force of tubing pressure on firing pin 168 accelerates the firing pin downward, forcing balls 174 out of groove 176. The firing pin strikes a detonator 182 at the lower end of detonator cavity 180, which ignites a length of detonator cord 184 (primacord), which in turn ignites a trigger charge 186 at the lower end of the hydraulically programmable firing head 10.

Although the configuration shown is sized to contain up to five c-ring locks 146, the effective number of locks in the section may be increased by appropriate dimensional adjustments and the addition of more c-rings to ratchet housing 84, or by adding a lock extension kit to the bottom of the firing head that contains additional locks and a lock-releasing actuator that is blocked from receiving activating elevated pressure conditions until release sleeve 164 is raised.

Figure 7:
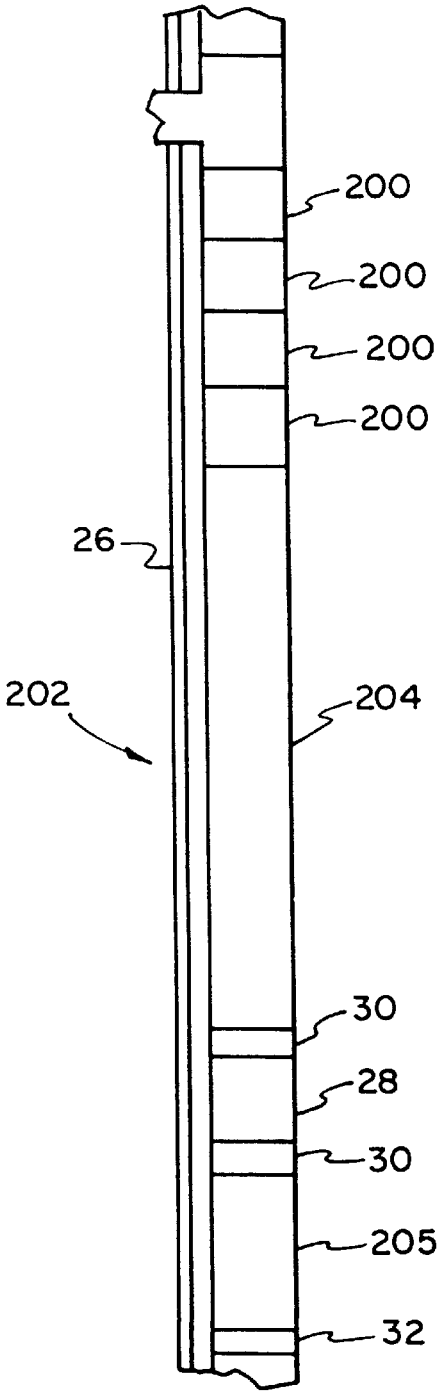
FIG. 7 is a schematic illustration of a functional section of a string of tools, according to a second embodiment.

Referring to FIG. 7, a second embodiment of the invention employs pilot valves 200 as locks within a functional string section 202. A series of time-delay pilot valves 200 is located, in some cases, immediately above a pressure-activated firing head 204 of an associated tool 205 as shown. In other cases, the lowest valve 200 in the series is constructed to directly release a firing pin to activate tool 205.

Figure 8:
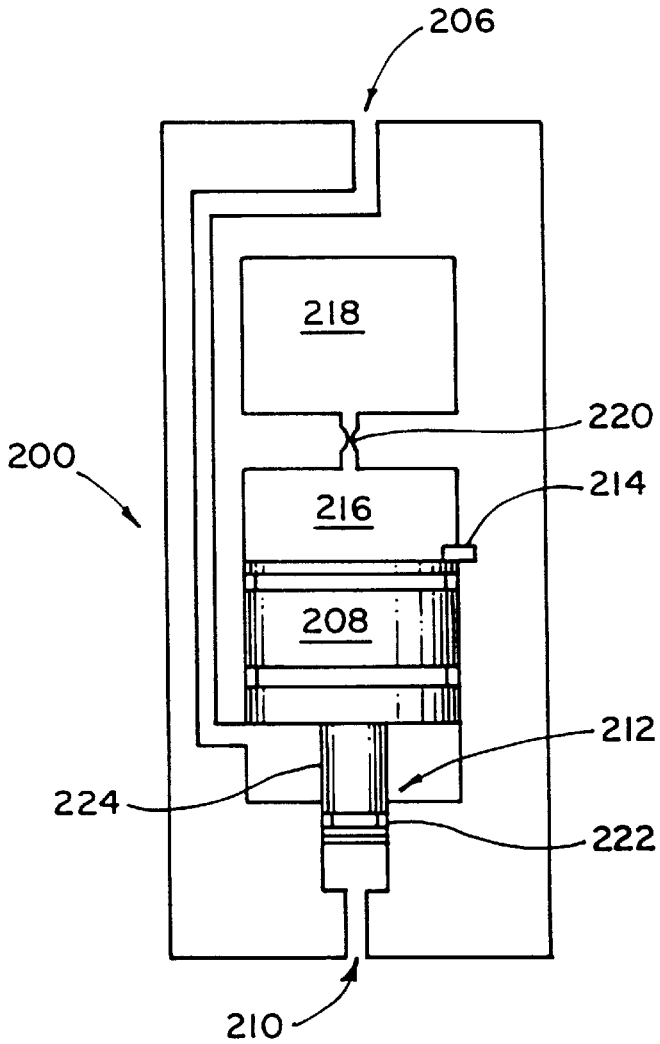
FIG. 8 is a functional illustration of a pilot valve of the embodiment of FIG. 7.

Referring also to FIG. 8, each pilot valve 200 functions as a time-delay lock that is activated when the pressure at an inlet 206 of the respective valve reaches an activation level, e.g. $P_A$ in FIG. 2. Once activated, the valve is arranged to open, after a given time delay, hydraulic communication between inlet 206 and outlet 210 by moving a piston 208 to expose a port 212 to inlet pressure. Until the pressure at inlet 206 reaches an activating level, piston 208 is held in a port-blocking position by shear pins 214. A cavity 216 above piston 208 is filled with a viscous fluid, and is connected to an initially unpressurized cavity 218 through an orifice 220. Valve 200 is configured such that inlet 206 may be exposed to hydrostatic pressure, e.g. a pressure level of $P_H$ in FIG. 2, without shearing pin 214. Once the shear pin has been severed by an application of an activating pressure condition, e.g. a pressure of level $P_A$, inlet pressure will move piston 208 upward, forcing the fluid in cavity 216 through orifice 218 at a predeterminable rate. Consequently, port 212 will be exposed when an o-ring seal 222 on piston stem 224 has moved upward an appropriate distance, the timing of the exposure of port 212 being a function of the predeterminable rate of motion of piston 208. During the relatively slow motion of piston 208, which is preferably configured to expose port 212 after about five minutes from the application of the respective activating pressure condition, the inlet pressure, e.g. tubing pressure in the present embodiment, is lowered to a hydrostatic level low enough that successive valves connected to outlet 210 will not be immediately activated by the exposure of port 212, but high enough to continue to force piston 208 upward. The rate of motion of piston 208 under a given pressure condition can be adjusted by changing the size of orifice 220 or the viscosity of the fluid in cavity 216. A rupture disk may be used in series with orifice 220 in lieu of shear pins 214. In some embodiments, piston stem 224 of the lowest lock valve 200 in a series of lock valves is directly attached to a release sleeve operator, such as release sleeve operator 108 in FIG. 4, to release a firing pin when moved.

As connected in series in FIG. 7, the outlet 210 of each pilot valve 200 is in hydraulic communication with the inlet 206 of the next-lowest valve, with the outlet 210 of the lowest valve being in communication with firing head 204. In this embodiment, the tubing pressure is increased to activate the upper unreleased pilot valve lock 200 in the string section 202, and, according to the predetermined pressure cycle parameters as described above, is returned to a hydrostatic level before the activated pilot valve opens, such that by the time the activated valve opens to permit tubing pressure to be applied to the next lowest valve 200, tubing pressure has been reduced to a non-activating level. Upon the next application of activating pressure, the next lowest unreleased valve 200 will be activated, and so forth, until firing head 204 is in hydraulic communication with tubing pressure. At this point, another application of a pressure cycle activates the firing head, initiating the detonation of a trigger charge within the firing head.

In either embodiment heretofore described, the detonation of a trigger charge in the firing head (10 and 204 in FIGS. 1 and 7, respectively) ignites subsequent detonations through sealed ballistic transfers 30 and safety spacer 28, igniting a detonation within a tool associated with the firing head to perform a desired downhole function. As previously described, it should also be realized that the lock-releasing mechanisms described above can be employed to perform many other downhole tasks than the detonation of a trigger charge within a firing head. The release sleeve operator 108 of the first embodiment may, for instance, open a valve or move a functional sleeve instead of releasing a firing pin.

Hydraulic lines 26, shown in FIGS. 1 and 7, are preferably positioned external to the functional tools 14, 16, 18 and 212 of the string. This positioning is particularly advantageous when the tools include perforating guns 14, to reduce the possibility of the lines being damaged by the firing of the charges of the gun and opening an undesirable path between the activation fluid in tubing 22 and the annulus of the well. Lines 26 are positioned next to guns 14 such that the detonation of the gun will not damage the lines.

In other embodiments, as when tubing 22 of FIG. 1 is replaced with a cable, the firing heads are activated by cyclically pressurizing the well annulus around the tool string. If the well will also be pressurized for other purposes with the tool string downhole, e.g. for bridge plug or flow testing, extra locks, e.g. c-rings 146 in FIG. 4 or pilot valves 200 in FIG. 7, can be added to appropriate sections of the tool string for release by the test pressure cycles. Thus activation of the tool string by the test pressure, or advancement from the desired function sequence, can readily be avoided.

Although, as in the present embodiments, the locks of the invention are preferred to be constructed to be released at about the same activation pressure level $P_A$ (FIG. 2), various locks within the string of tool sections may be built to release at different pressure levels, further increasing the in-field flexibility of the invention to perform various downhole function sequences.

Other embodiments and advantages will be evident to those skilled in the art, and are within the scope of the following claims.

What is claimed is:

1. A downhole device for performing a function in a well, the device comprising:

a series of hydro-mechanical locks that prevent occurrence of said function until desired, the hydro-mechanical locks comprising displaceable elements each being capable of being released directly by a respective elevated hydraulic activating pressure condition, each displaceable element released by being moved from a locking position to an unlocking position, the locks of said device being arranged for sequential operation such that a lock in the series cannot be released until after the hydraulic pressure conditions required to release any preceding locks in the series have occurred.

2. The downhole device of claim 1 further comprising:

a housing, and a port in said housing in hydraulic communication with a remote hydraulic pressure source via the well or by pressure-transmitting structure such as casing or tubing in the well.

3. The downhole device of claim 1, further comprising a common hydraulic actuator, the actuator arranged to displace said one or more displaceable elements sequentially.

4. The downhole device of claim 3 in which said actuator is responsive to an increase in hydraulic pressure to engage an element and to a subsequent decrease in hydraulic pressure to move the element from a locking to an unlocking position.

5. The downhole device of claim 3 in which the actuator comprises a hydraulic piston.

6. The downhole device of claim 3 in which the actuator is biased to a first position by a spring, said activating pressure condition moving said actuator to a second, activated position.

7. The downhole device of claim 6 in which the spring comprises a compressible fluid which is compressed in a first chamber by said actuator.

8. The downhole device of claim 7 further comprising an orifice for restricting a flow of said compressible fluid from said first chamber to a second chamber, enabling said respective activating pressure condition to cause said actuator to compress the fluid in said first chamber.

9. The downhole device of claim 8 further comprising a third chamber and a floating piston disposed between the second and third chambers, said floating piston containing a one-way check valve constructed to enable flow from said second chamber to said third chamber.

10. The downhole device of claim 3 in which the elements each comprises a ring and said actuator comprises a ring gripper for moving the ring.

11. The downhole device of claim 10 including a lock housing having a first bore in which said ring is resiliently radially compressed in a locking, unreleased condition.

12. The downhole device of claim 11 in which the lock housing includes a second bore into which the ring is movable to an unlocking, released position, said second bore being larger in diameter than said first bore.

13. The downhole device of claim 10 in which the ring has a cam surface for engagement by said actuator.

14. The downhole device of claim 13 in which the gripper comprises a finger with a cam surface for engaging the cam surface of said ring.

15. The downhole device of claim 14 in which the gripper further comprises a lift surface for lifting any previously released rings of the device to enable the disengagement of an engaged ring from said cam surface of said gripper.

16. A downhole device for use in a well, comprising a lock housing having a relatively small bore and a relatively large bore;

a port in hydraulic communication with a remote hydraulic pressure source;

a set of one or more displaceable c-rings resiliently radially compressed in a locking, unreleased condition in said small bore, each ring having an engageable cam surface;

a common hydraulic actuator having a finger with a cam surface for engaging the cam surface of said ring and a lift surface for lifting any previously released rings of the device to enable the disengagement of any engaged ring from said cam surface of said finger, the actuator being constructed and arranged to move said c-rings sequentially, in response to a corresponding sequence of elevated hydraulic pressure conditions, from said small bore to an unlocking, released position in said large bore; and a spring for biasing said actuator to a first position, said actuator being responsive to an increase in hydraulic pressure to advance to a second position to engage a ring, and to a decrease in hydraulic pressure to return to said first position to move said engaged ring.

17. A string of tools for use in a well comprising a number of sections arranged in a physical order within the string along a string axis, at least three of said sections each having a downhole device with a series of hydro-mechanical locks that prevent activation of the section, the hydro-mechanical locks each being capable of being released directly by a respective elevated hydraulic activating pressure condition, the locks of said device being arranged for sequential operation such that a lock in the series cannot be released until after the hydraulic pressure condition required to release any preceding lock in the series has occurred, the string being arranged to activate the sections in an order other than the physical order of said sections along said axis.

18. The string of tools of claim 17 in which said sections are constructed to enable activating pressure conditions to be applied substantially simultaneously to all of said sections having said devices.

19. The string of tools of claim 18 in which a first device has at least one fewer hydro-mechanical lock than a second device, the actuating pressure conditions for releasing the locks of said first and second devices being correlated such that pairs of the locks of said first and second devices are substantially simultaneously released, resulting in all locks being released in said first device while a lock remains unreleased in said second device.

20. A downhole device for use in a well, comprising an actuator arranged to move along an axis in response to an activating pressure condition, an operator engageable by said actuator and arranged to activate the device when moved, and at least one lock element comprising a ring and engageable by said actuator and disposed axially, in a locking position, between said actuator and said operator, said actuator arranged to, in response to a first activating pressure condition, engage and move said lock element to a non-locking position, and subsequently, in response to a second said activating pressure condition, to engage and move said operator.

21. The downhole device of claim 20 in which there are more than one of said lock elements arranged in series between said actuator and said operator.

22. The downhole device of claim 20 in which the axial motion of said actuator is limited by said lock element.

23. The downhole device of claim 22 in which said actuator comprises a ring gripper for moving the ring.

24. The downhole device of claim 23 including a lock housing having a first bore in which said ring is resiliently radially compressed in a locking, unreleased condition.

25. The downhole device of claim 24 in which the lock housing has a second bore into which the ring is movable to an unlocking, released position, said second bore being larger in diameter than said first bore.

26. The downhole device of claim 23 in which the ring has a cam surface for engagement by said actuator.

27. The downhole device of claim 26 in which the gripper comprises a finger with a cam surface for engaging the cam surface of said ring.

28. The downhole device of claim 27 in which the gripper further comprises a lift formation for lifting previously released rings to enable the disengagement of an engaged ring from said cam surface of said gripper.

29. Apparatus for use in a well, comprising:

a device;

a plurality of locks coupled to prevent operation of the device until the locks have been released; and a lock release mechanism adapted to release the plurality of locks in sequence in response to pressure activations, each lock being released by moving the lock from a first locking position to a second unlocking position.

30. The apparatus of claim 29, wherein the locks include a series of displaceable elements that are removed one at a time by each activation of the lock release mechanism.

31. An apparatus for use in a well, comprising:

a device;

a plurality of locks coupled to prevent operation of the device until the locks have been released; and a lock release mechanism adapted to release the plurality of locks in sequence in response to pressure activations, wherein the locks include displaceable c-rings.

32. A system having a plurality of functional sections arranged in a physical order, at least two of the sections each having a lock device including a series of displaceable lock elements to prevent activation of the section, the lock device further including a lock release mechanism to release the locks in sequence by a plurality of activating pressure conditions, wherein a first section has a first number of locks and a second section has a second number of locks.

* * * * *